US006396403B1

(12) United States Patent
Haner

(10) Patent No.: US 6,396,403 B1
(45) Date of Patent: May 28, 2002

(54) CHILD MONITORING SYSTEM

(76) Inventor: Lenora A. Haner, 8509 Heatherwick Dr., Brandywine, MD (US) 20613

( * ) Notice: Subject to any disclaimer, the term of this patent is extended or adjusted under 35 U.S.C. 154(b) by 0 days.

(21) Appl. No.: 09/550,500

(22) Filed: Apr. 14, 2000

Related U.S. Application Data

(60) Provisional application No. 60/129,395, filed on Apr. 15, 1999.

(51) Int. Cl.[7] ..... G08B 23/00

(52) U.S. Cl. ..... 340/573.4; 340/539; 340/573.1

(58) Field of Search ..... 340/573.1, 573.3, 340/573.4, 573.7, 825.06, 825.49, 539, 425.5, 426; 342/357.06, 357.13; 42/1.09, 1.1, 1.11

(56) References Cited

U.S. PATENT DOCUMENTS

| | | | | |
|---|---|---|---|---|
| 4,765,276 A | * | 8/1988 | Kime | 119/29 |
| 4,785,291 A | | 11/1988 | Hawthorne | 33/293 |
| 4,899,135 A | | 2/1990 | Ghahariiran | 340/573.4 |
| 4,952,928 A | * | 8/1990 | Carroll et al. | 340/539 |
| 4,982,281 A | | 1/1991 | Gutierrez | 348/151 |
| 5,086,290 A | | 2/1992 | Murray et al. | 340/539 |
| 5,111,290 A | | 5/1992 | Gutierrez | 348/143 |
| 5,115,223 A | | 5/1992 | Moody | 340/573.1 |
| 5,289,163 A | | 2/1994 | Perez et al. | 340/539 |
| D345,314 S | | 3/1994 | Chandra | D10/106 |
| D354,973 S | | 1/1995 | Hisatune et al. | D16/203 |
| 5,682,133 A | * | 10/1997 | Johnson et al. | 340/426 |

FOREIGN PATENT DOCUMENTS

| | | |
|---|---|---|
| EP | 0 335 467 | 10/1989 |
| GB | 2 121 219 A | 12/1983 |

* cited by examiner

*Primary Examiner*—Van Trieu
(74) *Attorney, Agent, or Firm*—Richard C. Litman

(57) ABSTRACT

A child monitoring system including a combination bracelet and camera transmitting assembly, and a receiver for tracking and providing audible and visual contact with a child or object within a predetermined area or domain. The bracelet transmitting assembly is releasably attached to the wrist or ankle of a user, i.e. a child, and transmits signals for detection by a remote hand-held or belt worn monitor. The camera transmitting assembly is also attached to a user via a clothing article such as a button or pocket to obtain and transmit video signals to the monitor. For longer distance monitoring, GPS microminiaturized technology may be employed. The bracelet transmitting assembly includes a locking mechanism and circuitry for two way-speaker communication or monitoring. A plastic sleeve is also provided for the bracelet as a protective covering. The receiver includes a GPS switch, activated to display the latitude-longitude coordinates of the child, who wears a GPS receiver/transmitter and antenna.

16 Claims, 4 Drawing Sheets

CHILD MONITORING SYSTEM

CROSS-REFERENCE TO RELATED APPLICATION

This application claims the benefit of U.S. Provisional Patent Application Ser. No. 60/129,395, filed Apr. 15, 1999.

BACKGROUND OF THE INVENTION

1. Field of the Invention

The present invention relates generally to child monitoring systems, and more specifically, to a multi-piece electronic child monitoring device, adapted for monitoring real-time environmental images of a lost child within a certain area or domain, or at an extended distance, using microminiaturized GPS technology.

2. Description of Related Art

A number of child monitoring devices have been devised for maintaining surveillance on children, for example, who wander from a particular area or domain. It has become increasingly difficult for parents and/or guardians to monitor a single child or groups of children by human effort alone. The increase of lost children in shopping malls, play areas, or area kidnapping, within the United States alone has been cause for developing auxiliary measures or devices for parents or guardians to detect and retrieve children who have left a particular area. The advent of these devices began with the rudimentary methods of announcing over a loud speaker, particularly in shopping malls, that a child has been found and is at a particular location for pickup by a parent or guardian.

Most of the conventional child monitoring devices utilize this principle with electronic devices that transmit signals from a child to a receiver or monitor within a certain range. The transmitter is usually attached to a child via bracelet, shoe, etc. for tracking by a remote monitor. An alarm or other audible means is typically disposed within the monitor to signify when the child, pet, or other object has gone beyond a predetermined area or range.

One significant problem with the conventional child monitoring devices is the difficulty in actually locating the child or object beyond a specific range. Signal strength monitors have been used in this particular case, but these devices have long suffered signal interferences which mislead or become distorted to adequately aid in a parent or guardian finding the actual location of a child or object.

Often environmental "landmarks" are essential to a parent or guardian, especially in a familiar surrounding, for enabling quick and easy retrieval of a child accordingly. For potentially life threatening circumstances, a safe and accurate child monitoring device which has the capability to provide real-time monitoring as a remote family monitoring measure is lacking among most of the conventional child monitoring devices.

For example, U.S. Design Pat. No. 345,314 issued to Chandra discloses an ornamental design for a combined transmitter and receiver having a substantially rectangular shape and a means for hooking or attaching both the transmitter and receiver elements to the belt of a user's pants. Apertures which appear to be a means for transmitting and receiving audio signals are disposed within a front bottom surface of the structure. A switch having a knurled surface is disposed within a side surface, perhaps for activating and deactivating the device. U.S. Design Pat. No. 354,973 issued to Hisatune, et al., illustrates another ornamental design for a surveillance video camera. The camera is disposed within a central portion of a triangular-shaped or pyramidal-shaped structure or housing for obtaining visual images of an object.

U.S. Pat. No. 4,785,291 issued to Hawthorne discloses a distance monitor for child surveillance having an unmodulated radio frequency transmitter carried by or affixed to the person to be monitored, and a receiver monitor located at a remote location for providing a visual color coded and/or audible signal in direct proportion to the received transmitted signal.

U.S. Pat. No. 4,899,135 issued to Ghahariran discloses a child monitoring device utilizing an ultra-sonic or radio frequency monitoring system comprising a transmitting unit carried by the child and receiving unit carried by the child's guardian. The receiving unit alerts the guardian when the child strays beyond a predescribed distance. The device is primarily an audible transmitting device.

U.S. Pat. Nos. 4,982,281 and 5,111,290, both issued to Guitierrez, disclose a surveillance device wherein a miniature television surveillance camera capable of transmitting signals to a monitor is mounted in a mannequin so that a lens portion has a desired field of view. The lens is disposed in the iris and pupil of at least one eye. The device does not provide transmitted signals from an object to the camera disposed within the mannequin.

U.S. Pat. No. 5,115,223 issued to Moody discloses a personnel location monitoring system and method employing a band attached to an individual that has a pressure actuated tamper indicator disposed thereon in the form of a latch, and a monitoring/tracking unit which indicates whether an individual has left a predetermined area. When the latch is open, pressure is removed and the transmitter is rendered inoperative or indicates that the band has been removed from the subject. An audible alarm also signals when the individual has moved beyond a certain range. Other signals such as a smoke detected signal and a satellite signal are monitored to obtain signals which indicate hazardous building or room conditions and positional data respectively.

U.S. Pat. No. 5,086,290 issued to Murray et al. discloses a mobile perimeter monitoring system comprising a battery powered transmitter adapted to be placed upon a person. The person or user carriers a receiver which responds to a code transmitted by the transmitter and provides an in-range or out-of-range indication. A visual image of the person within a specific environment is not performed; rather, a visual alarm signal is depicted when the user or person has gone beyond a specific range.

U.S. Pat. No. 5,289,163 issued to Perez et al. discloses a child monitoring and locating device comprising a plurality of light emitting diodes (LEDs) disposed in circular arrangement within a surface of a hand-held receiver for indicating a specific direction in which an object can be located. A transmitter is attached to a child for transmitting a radio signal to the receiver within a predetermined range. When the child is beyond the predetermined range the signal becomes weak and an audible signal is made in the form of a beep or vibration. The directional range is based on a 360° directional circle.

Foreign publications by Jong-Wu (GB 2121219) and Heister et al. (EP 0335467) disclose circuit elements for shoes or footwear. The circuits are configured to measure the number of steps made by a user and provide audible sounds in the form of music or simulate light signals to be seen by others respectively.

None of the above inventions and patents, taken either singly or in combination, is seen to describe the instant invention as claimed.

SUMMARY OF THE INVENTION

The child monitoring system according to the invention includes an electronic bracelet, camera assembly and monitor or receiver for tracking and providing audible and visual contact with a child or object within a certain area or domain. The bracelet is releasably attached to the wrist or ankle of a user and transmits signals for detection by a remote hand-held or belt worn receiver. A camera assembly is also attached to a user via a clothing article such as a button or pocket to obtain and transmit video signals to the monitor.

The monitor receives a plurality of signals which indicates at least three conditions. The first condition is signaled by an audible alarm which is activated when a child or object has gone beyond a predetermined area or range. The second condition is detected via a two-way speaker which allows for direct communication with the child, and the third condition is detected by the video camera and displayed via a video monitor disposed within a surface of the receiver. The bracelet includes a locking mechanism and circuitry for two way-speaker communication or monitoring. A plastic sleeve is also provided for the bracelet as a protective covering.

In another, longer distance monitor embodiment of the invention, microminiaturized GPS technology is employed, including a GPS transmitter/receiver attached to the child's clothing, and a GPS information receiver including a selective switch activated indicator giving latitude/longitude readouts for child location.

Accordingly, it is a principal object of the invention to provide a child monitoring system for real-time tracking and monitoring.

It is another object of the invention to provide a portable child monitoring system which remotely relays environmental images or landmarks within the vicinity a lost child.

It is a further object of the invention to provide a child monitoring system which produces and audible signal when a child or object has gone beyond a predetermined area or domain.

Still another object of the invention is to provide a child monitoring system which produces familiar voice signals to a child for correction or comfort.

A further object of the invention is to provide a child monitoring system employing microminiaturized GPS technology to provide at least the latitude-longitude coordinates of the child via a selective GPS switch on the monitoring receiver unit of the system.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is directed to a monitoring system for tracking and monitoring children, older citizens, pets, etc. In a first embodiment of the invention, this is done within a predetermined area or range as diagrammatically illustrated in FIG. 1. The preferred elements comprising the system of the invention are depicted in FIGS. 1–4, and are generally referenced as 5, 7, 9 and 11 respectively.

Figure 1:
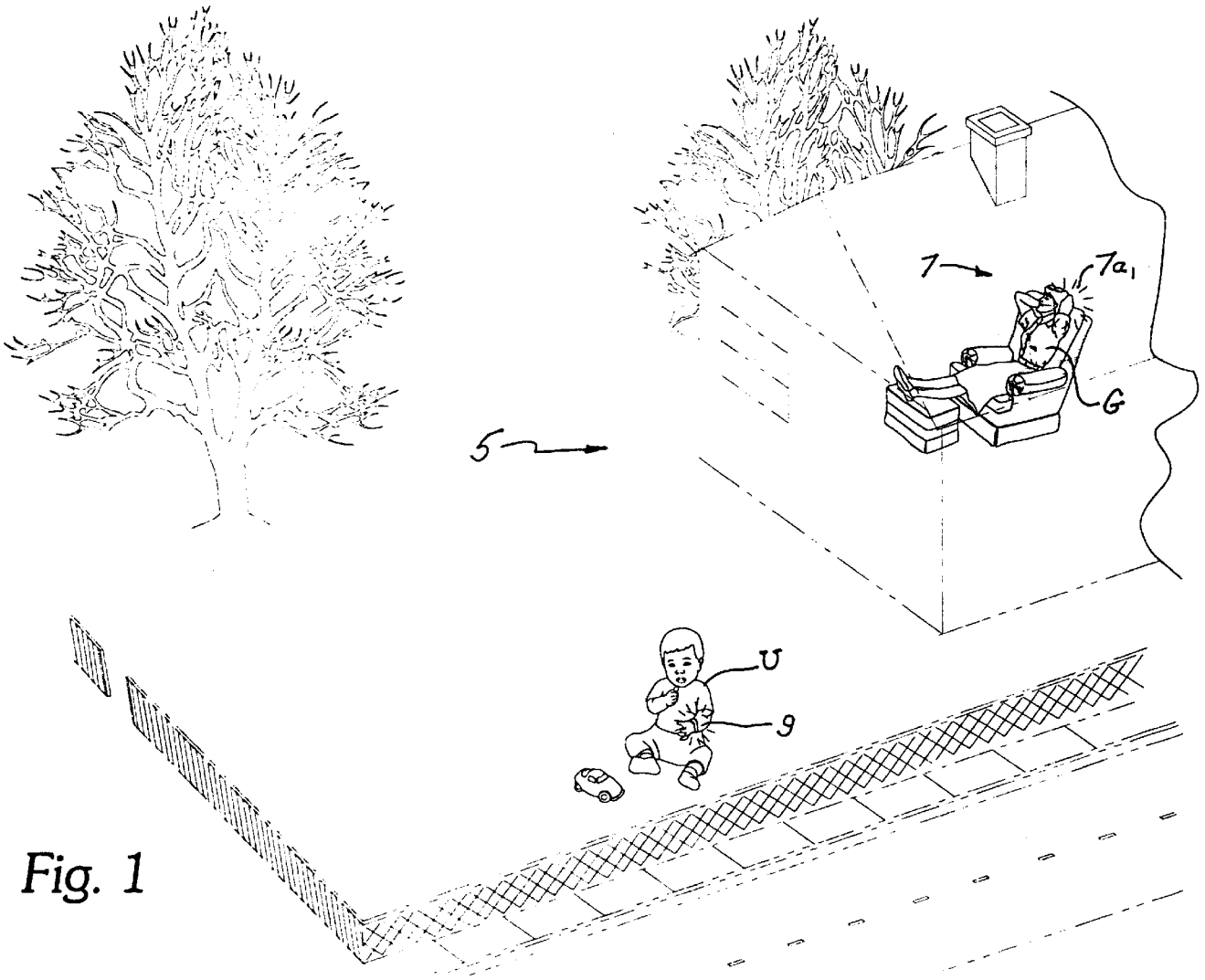
FIG. 1 is an environmental, perspective view of a child monitor according to the present invention.
Figure 2:
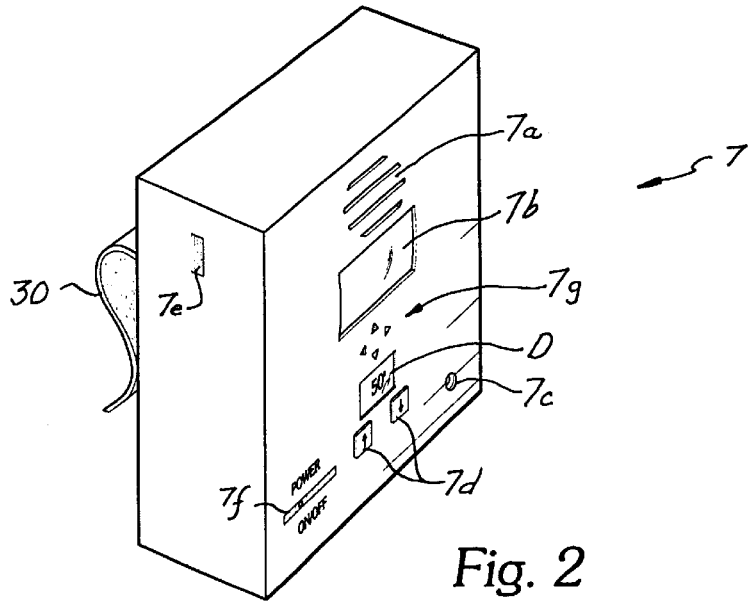
FIG. 2 is a perspective view of a receiver according to the invention.
Figure 3:
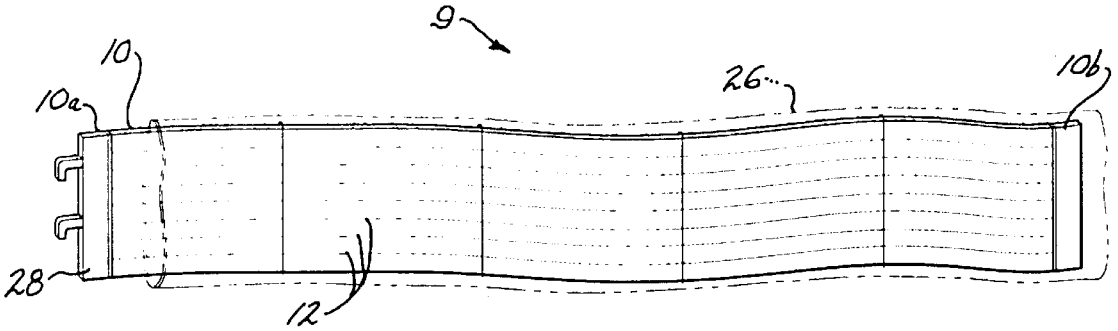
FIG. 3 is a perspective view of a bracelet sensor and transmitter according to the invention.
Figure 4:
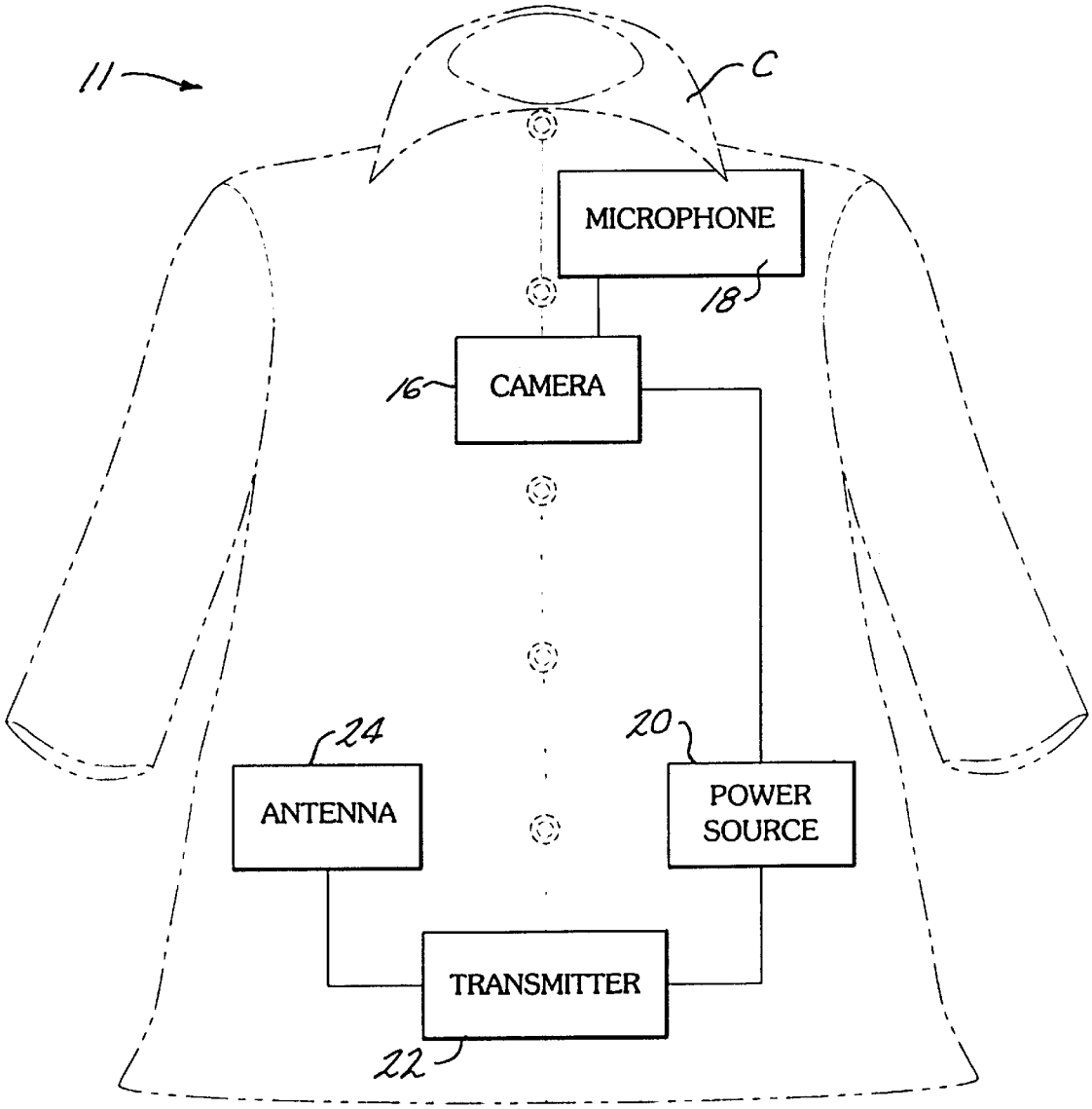
FIG. 4 is a block diagram of an attachable camera system according to the invention.

As best seen in FIGS. 2–4, the child monitoring system according to the invention comprises a combination transmitter assembly 9, 11 and receiver 7. With reference to FIG. 1, the receiver 7 detects a plurality of signals for real-time monitoring of a user U by a parent or guardian G. The combination transmitter assembly comprises a first transmitting assembly 9 and a second transmitting assembly 11, which provides visual and audible tracking of the user U.

When a child is playing in a familiar setting such as a home, the combination transmitter assembly can be used in a conventional way with only a single transmitting element 9 for example. The first transmitting assembly 9 comprises a bracelet transmitting assembly 10 illustrated in FIG. 3, having an electronic means 12 for transmitting electronic signals for electronically tracking a user U. Any conventional means for transmitting a tracking signal can be used. The preferred type transmitter is an unmodulated bracelet transmitter having a crystal oscillator and a buffer amplifier having a plurality of sensor wires 12 for producing around 27.145 MHZ of radio frequency (R.F.) output at the level of about 8 milliwatts. This type of transmitter can be readily constructed by one of ordinary skill in the art and is consistent with U.S. Federal Communication Commission Regulations for unlicensed operations.

Also diagrammatically illustrated in phantom lines in FIG. 3 is a protective sleeve 26 for covering and protecting the bracelet 10. The sleeve 26 is preferably made of a plastic material and serves as a comfortable interface material between the skin of the user U and the surface of the bracelet assembly 10. A locking mechanism 28 is operatively attached at the ends 10*a* and 10*b* of the bracelet 10 for securing the transmitter bracelet 10 and sleeve 26 to the wrist or ankle of the user U.

As seen in FIG. 4, the second transmitting assembly 11 comprises a camera 16, microphone 18, power source 20, transmitter 22 and antenna 24 which delivers both audible and video signals to the receiver 7. This particular arrangement employs a miniature camera which can be easily adapted to a clothing article C of a child or other user U.

The receiver 7 diagrammatically illustrated in FIG. 2 is a portable hand-held receiver having internal D.C. power (not shown), and is configured for receiving radio frequencies (R.F.) signals. The receiver can be adapted as a rechargeable unit via a AC adapter for recharging the unit or alternatively providing continuous AC power, as is well known in the art. The receiver 7 includes a speaker 7*a* for transmitting and receiving audible signals $7a_1$ (see FIG. 1), a video monitor 7*b,* a visual and audible alarm 7*c,* and a tracking adjusting means 7*d* for adjusting tracking according to a predetermined distance D. The receiver is electronically configured to detect at least three signals (i.e. video, distance tracking and audible signals) for audible and visual tracking of a child, for example, in real-time. The electronic circuit elements for the receiver 7 are considered to be well known to one of ordinary skill in the art.

The receiver 7 also includes a switch means 7*e* for activating and deactivating the receiver 7, and a power spectrum indicator 7*f* for indicating a specific power level of the receiver. The switch 7*e* has a knurled surface or a plurality of ridges for providing a sufficient contact force for moving the switch with minimal slippage at the interface between the surface of the switch 7*e* and the finger or thumb of a monitor, parent or guardian G.

A fourth indicator is optionally provided and is diagrammatically illustrated in FIG. 2 as a multi-directional indicator 7*g*. A sound modulation means (not shown) can be included to indicate north, south, east and west directions, so that even those who have impaired vision can be assisted in finding a lost child, older person, pet, etc.

Figure 5:
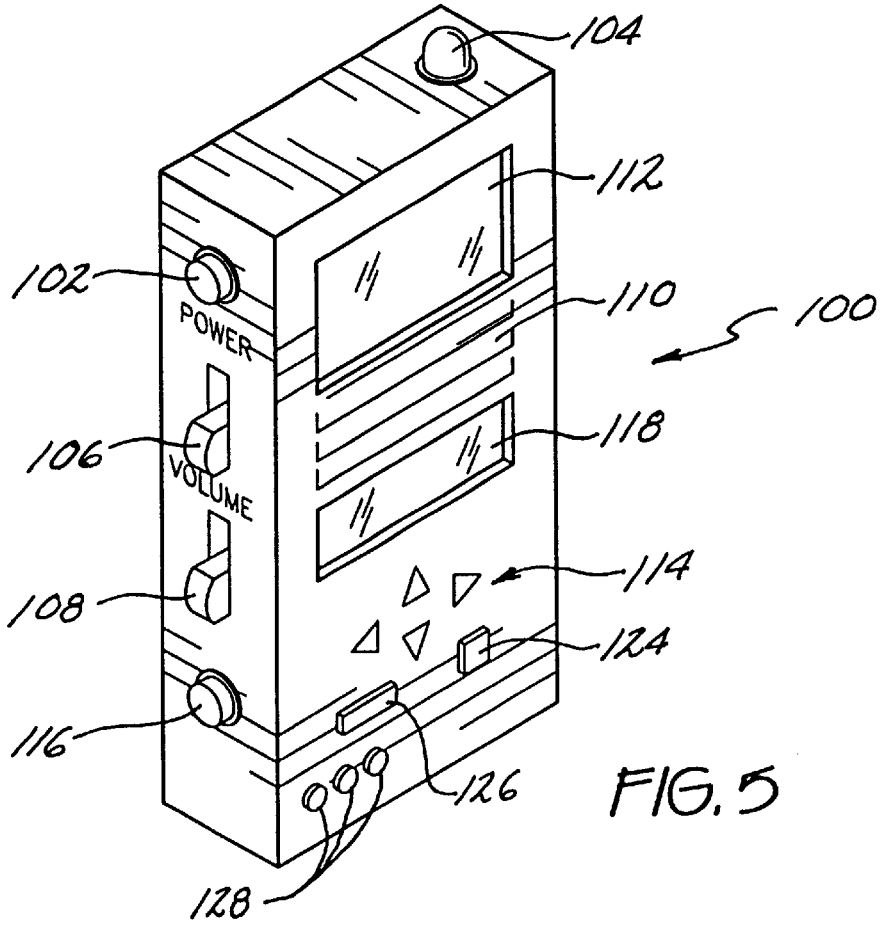
FIG. 5 is a perspective view of a receiver according to an additional embodiment of the invention.
Figure 6:
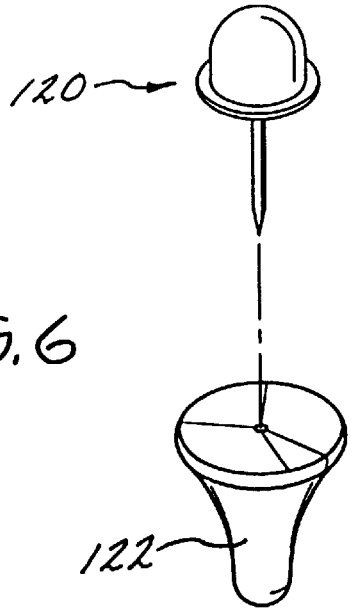
FIG. 6 is a perspective view of a microminiaturized GPS receiver according to the additional embodiment of the invention.

With reference to FIGS. 5 and 6, the additional embodiment will be discussed, which is similar to those discussed above, but has the additional feature of GPS technology, permitting a wider distance range for use of the invention. A modified receiver 100 is shown in FIG. 5 having a power on/off switch 102 and a power indicator (light) 104. A volume control is provided at 106; this could be in the form of a rotary knob instead of the slide control shown. An audio/vibrate alarm is indicated at 108, an audio speaker at 110, a video screen at 112, and a lighted, multidirectional indicator at 114. These items are similar to those discussed above with reference to receiver 7.

A GPS mode switch is located at 116, and this switch alternates the display on screen 118 between distance tracking (per the embodiment of the receiver shown in FIG. 2) and latitude/longitude coordinates from a GPS input. The input may take any one of a wide variety of forms. One is shown at 120, this being a microminiaturized GPS antenna and receiver resembling a tie tack somewhat, and anchored through a user's clothing by an anchor 122. Power for 120 may be provided from a suitable power source such as 20, FIG. 4, and the transmitter 22 and antenna 24 are used to relay the GPS coordinates back to receiver 100. With further reference to FIG. 5, pause 124 and reset 126 controls provide their conventional functions with respect to the several bands, visual, audible, and GPS visual. Modular lights or LEDs 128 indicate which alarm band is in use.

Returning again to FIG. 2, an attachment clip 30 for attaching the receiver 7 to a belt or pocket of a user is disposed on a rear surface of the receiver 7. This attachment clip 30 can be integrally formed with the receiver housing by injection molding techniques, or can be manufactured separately and then attached by mechanical fasteners as a separate spring-clip attachment. This same clip may be provided with the receiver 100. Another advantage of the child monitoring assembly as disclosed herein is the use of plastic materials where feasible to produce a light-weight and portable system.

It is to be understood that the present invention is not limited to the embodiments described above, but encompasses any and all embodiments within the scope of the following claims.

I claim:

1. A child monitoring system comprising:

a receiver configured to detect a predetermined plurality of signals for real-time monitoring of a child;

a first transmitting assembly including a bracelet transmitting assembly having a means for transmitting electronic signals to said receiver for electronically tracking the child; and a second transmitting assembly including a camera assembly attached to an article of clothing of a child and having a camera, microphone, power source, transmitter and antenna, said second assembly configured to deliver both audible and video signals to said receiver.

2. The child monitoring system according to claim 1, wherein said receiver is a portable hand-held receiver.

3. The child monitoring system according to claim 2, wherein said hand-held receiver further comprises a speaker means for transmitting and receiving audible signals, a video monitor, at least four directional indicators, an audible alarm, and a tracking adjusting means for adjusting tracking according to a predetermined distance.

4. The child monitoring system according to claim 3, wherein said receiver further comprises a switch means for activating and deactivating said receiver, and a power spectrum indicator for indicating a specific power level of said receiver.

5. The child monitoring system according to claim 1, wherein said bracelet transmitting assembly further comprises a sleeve for covering and protecting said bracelet.

6. The child monitoring system according to claim 6, wherein said sleeve is made of a plastic material.

7. The child monitoring system according to claim 1, wherein said bracelet transmitting assembly further comprises a locking mechanism for locking said bracelet upon being attached to a limb of the child.

8. The child monitoring system according to claim 1, wherein said receiver further comprises an attachment means for attaching said receiver to an article of clothing.

9. The child monitoring system according to claim 1, wherein there is further provided a GPS receiver for determining the latitude and longitude coordinates of the child, wired to said second transmitting assembly, said receiver being configured to provide a readout of the latitude and longitude coordinates determined by said GPS receiver.

10. The child monitoring system according to claim 9, wherein said receiver includes a screen and means for conveying GPS latitude and longitude information to said screen in visual, readable format.

11. The child monitoring system according to claim 10, further comprising means for providing distance-from-receiver data and feeding the same in readable format to said screen, there further being switch means for alternating distance-from-receiver data and GPS data feeds to said screen.

12. The child monitoring system according to claim 10, said receiver further including visual means indicating whether a visual band, audio band or GPS signal band is in an alarm state.

13. A child monitoring system comprising:

a receiver configured to detect a predetermined plurality of signals for real-time monitoring of a child;

a first transmitting assembly including a GPS transmitting assembly having a means for transmitting electronic signals to said receiver for electronically indicating the latitude and longitude coordinates locating a the child; and a second transmitting assembly including a camera assembly attached to an article of clothing and having a camera, microphone, power source, transmitter and antenna, said second assembly configured to deliver both audible and video signals to the receiver.

14. The child monitoring system according to claim 13, wherein said receiver includes a screen and means for conveying GPS latitude and longitude information to said screen in visual, readable format.

15. The child monitoring system according to claim 14, further comprising means for providing distance-from-receiver data and feeding the same in readable format to said screen, there further being switch means for alternating distance-from-receiver data and GPS data feeds to said screen.

16. The child monitoring system according to claim 13, said receiver further including visual means indicating whether a visual band, audio band or GPS signal band is in an alarm state.

* * * * *